US010876532B2

(12) United States Patent
Tsuka

(10) Patent No.: US 10,876,532 B2
(45) Date of Patent: Dec. 29, 2020

(54) COMPRESSOR WITH PULSATION ATTENUATION SPACE DISPOSED IN INJECTION PASSAGE

(71) Applicant: DAIKIN INDUSTRIES, LTD., Osaka (JP)

(72) Inventor: Yoshitomo Tsuka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 295 days.

(21) Appl. No.: 15/553,512

(22) PCT Filed: Feb. 29, 2016

(86) PCT No.: PCT/JP2016/056010
§ 371 (c)(1),
(2) Date: Aug. 24, 2017

(87) PCT Pub. No.: WO2016/137003
PCT Pub. Date: Sep. 1, 2016

(65) Prior Publication Data

US 2018/0238330 A1 Aug. 23, 2018

(30) Foreign Application Priority Data

Feb. 27, 2015 (JP) ..... 2015-039611

(51) Int. Cl.
*F04C 29/06* (2006.01)
*F04C 29/12* (2006.01)
(Continued)

(52) U.S. Cl.
CPC ..... *F04C 29/065* (2013.01); *F04C 18/0215* (2013.01); *F04C 27/008* (2013.01);
(Continued)

(58) Field of Classification Search
CPC .... F04C 29/065; F04C 29/061; F04C 29/068; F04C 29/12; F04C 29/06; F04C 18/0215;
(Continued)

(56) References Cited

U.S. PATENT DOCUMENTS 4,041,984 A * 8/1977 Morel ..... F15D 1/08 137/842
5,046,935 A 9/1991 Iio et al.
(Continued)

FOREIGN PATENT DOCUMENTS

EP 2 330 300 A1 6/2011
JP 2-256889 A 10/1990
(Continued)

OTHER PUBLICATIONS

International Preliminary Report of corresponding PCT Application No. PCT/JP2016/056010 dated Sep. 8, 2017.
(Continued)

*Primary Examiner* — Deming Wan
(74) *Attorney, Agent, or Firm* — Global IP Counselors, LLP

(57) ABSTRACT

A compressor includes a compression chamber forming member, an injection passage, an injection pipe, and a pulsation attenuation space. The compression chamber forming member forms a compression chamber. The injection passage is formed in at least one of the compression chamber forming member and a separate member disposed in a surrounding area and connecting to the compression chamber. The injection pipe supplies refrigerant to the injection passage. The pulsation attenuation space is formed in one of the compression chamber forming member and the separate member disposed in the surrounding area so as to communicate with the injection passage. The pulsation attenuation space attenuates pulsation of refrigerant gas
(Continued)

flowing from the injection pipe into the compression chamber.

12 Claims, 7 Drawing Sheets

(51) Int. Cl.
*F04C 18/02* (2006.01)
*F04C 29/04* (2006.01)
*F04C 27/00* (2006.01)
*F04C 23/00* (2006.01)

(52) U.S. Cl.
CPC ..... *F04C 29/061* (2013.01); *F04C 29/068* (2013.01); *F04C 29/12* (2013.01); *F04C 23/008* (2013.01); *F04C 2240/806* (2013.01)

(58) Field of Classification Search
CPC ..... F04C 27/008; F04C 18/0253; F04C 18/0261; F04C 29/042
USPC ..... 418/55.2
See application file for complete search history.

(56) References Cited

U.S. PATENT DOCUMENTS

| | | | | |
|---|---|---|---|---|
| 5,299,916 | A * | 4/1994 | Schmid | F04C 29/068 417/312 |
| 5,722,257 | A | 3/1998 | Ishii et al. | |
| 6,293,776 | B1 * | 9/2001 | Hahn | F04C 18/0215 418/55.4 |
| 8,764,423 | B2 * | 7/2014 | Ignatiev | F04C 18/0215 418/55.5 |
| 2006/0127235 | A1 | 6/2006 | Shoulders | |
| 2007/0269326 | A1 | 11/2007 | Seibel et al. | |
| 2008/0152526 | A1 * | 6/2008 | Perevozchikov | F04C 18/0215 418/55.2 |
| 2011/0052437 | A1 * | 3/2011 | Iitsuka | F04C 18/0253 418/55.1 |
| 2015/0125330 | A1 | 5/2015 | Komura et al. | |
| 2015/0361981 | A1 | 12/2015 | Kawano | |

FOREIGN PATENT DOCUMENTS

| | | | |
|---|---|---|---|
| JP | 3-57894 | A | 3/1991 |
| JP | 9-105386 | A | 4/1997 |
| JP | 2008-133777 | A | 6/2008 |
| JP | 2008-523308 | A | 7/2008 |
| JP | 2010-185406 | A | 8/2010 |
| JP | 2013-209954 | A | 10/2013 |
| JP | 2013-227873 | A | 11/2013 |
| WO | 2014/118855 | A1 | 8/2014 |

OTHER PUBLICATIONS

International Search Report of corresponding PCT Application No. PCT/JP2016/056010 dated May 31, 2016.
European Search Report of corresponding EP Application No. 16 75 5747.9 dated Sep. 17, 2018.

* cited by examiner

COMPRESSOR WITH PULSATION ATTENUATION SPACE DISPOSED IN INJECTION PASSAGE

CROSS-REFERENCE TO RELATED APPLICATIONS

This U.S. National stage application claims priority under 35 U.S.C. § 119(a) to Japanese Patent Application No. 2015-039611, filed in Japan on Feb. 27, 2015, the entire contents of which are hereby incorporated herein by reference.

TECHNICAL FIELD

The present invention relates to a compressor, and relates particularly to a compressor in which intermediate injection is performed.

BACKGROUND ART

Conventionally, there have been cases where intermediate injection is performed for the purpose of improving the efficiency of a compressor used in a refrigeration system, and there have been cases where an injection passage is formed in, for example, a fixed scroll member of the compressor in order to guide refrigerant injected into a compression chamber of the compressor. In the intermediate injection, refrigerant at a pressure (intermediate pressure) between a low pressure in the refrigeration cycle and a high pressure in the refrigeration cycle is injected into the compression chamber.

In the case of performing intermediate injection, vibration of pipes in the outdoor unit and radiating sound are produced by pulsation during injection, and when the vibration is large, there is also the potential for this to lead to pipe bending, which is a problem in terms of reliability.

In order to prevent this, in the compressor disclosed in JP A No. 2010-185406 for example, pulsation is reduced by providing a miller on the outer side of the compressor as a measure to counter vibration of the pipes and the radiating sound.

SUMMARY

Technical Problem

However, when a weighty muffler is provided in the middle of the pipe system, a new vibration mode whose mass is the muffler occurs. Additionally, to suppress this, it is necessary to increase the number of positions at which the pipes are secured, so the compressor becomes subjected to restrictions on the layout for installing the muffler, and in correspondence thereto costs also increase.

It is a problem of the present invention to provide a compressor that can reduce pulsation during injection without providing a muffler on the outer side of the compressor.

Solution to Problem

A compressor pertaining to a first aspect of the invention comprises a compression chamber forming member, an injection passage, an injection pipe, and a pulsation attenuation space. The compression chamber forming member forms a compression chamber. The injection passage is formed in the compression chamber forming member and/or a separate member disposed in the surrounding area and connects to the compression chamber. The injection pipe supplies refrigerant to the injection passage. The pulsation attenuation space is formed, so as to communicate with the injection passage, in the compression chamber forming member or the separate member disposed in the surrounding area and attenuates pulsation of refrigerant gas flowing from the injection pipe into the compression chamber.

In this compressor, the pulsation attenuation space communicates with the injection passage, so pulsation during injection is attenuated by the pulsation attenuation space. As a result, it is no longer necessary to provide a muffler or the like on the outer side of the compressor, and a suppression of pipe vibration and a reduction in cost can be achieved.

A compressor pertaining to a second aspect of the invention is the compressor pertaining to the first aspect, wherein the compression chamber and the injection passage communicate with each other by an injection port. The pulsation attenuation space is an expansion chamber having a larger flow path cross-sectional area than the flow path cross-sectional area of the injection port.

In this compressor, the refrigerant expands when it flows into the expansion chamber, so pulsation of the refrigerant is reduced as a result. That is to say, the compression chamber fulfills a function as a muffler that suppresses pulsation of the refrigerant. Therefore, pulsation during injection is attenuated without providing a muffler or the like on the outer side of the compressor. As a result, a suppression of pipe vibration and a reduction in cost can be achieved.

A compressor pertaining to a third aspect of the invention is the compressor pertaining to the second aspect, wherein the ratio of a flow path cross-sectional area of the expansion chamber to a flow path cross-sectional area of the injection port is in the range of 2.0 to 50.

A compressor pertaining to a fourth aspect of the invention is the compressor pertaining to the second aspect, wherein the direction in which the refrigerant flows into the expansion chamber and the direction in which the refrigerant flows out of the expansion chamber intersect each other, and the injection port lies on an extension line of the direction in which the refrigerant flows out of the expansion chamber. A flow path cross section on the refrigerant outflow side of the expansion chamber and a flow path cross section of the injection port have a positional relationship where they are parallel to each other and the area centers of the flow path cross sections do not lie on the same axis.

In this compressor, in a case where the refrigerant flow direction bends in the expansion chamber, it becomes easier for the refrigerant to flow if the flow path cross section on the refrigerant outflow side of the expansion chamber and the flow path cross section of the injection port are not disposed on the same axis than if they are coaxial in their area centers. As a result, the effect of not only reducing pulsation with the expansion chamber but also of flow-through resistance being reduced is obtained.

A compressor pertaining to a fifth aspect of the invention is the compressor pertaining to the first aspect, wherein the pulsation attenuation space is a Helmholtz space.

The injection passage communicates with the pulsation attenuation space that is a Helmholtz space, so pulsation of the refrigerant in the injection passage is attenuated. As a result, noise and vibration caused by pulsation of the refrigerant are reduced, so the fundamental frequency of the pulsation of the refrigerant and the natural frequency of each member forming the injection passage are kept from coinciding with each other, and noise and also vibration are reduced.

A compressor pertaining to a sixth aspect of the invention is the compressor pertaining to the first aspect, wherein the pulsation attenuation space is a side branch space.

The injection passage communicates with the pulsation attenuation space that is a side branch space, so pulsation of the refrigerant in the injection passage is attenuated.

As a result, noise and vibration caused by pulsation of the refrigerant are reduced, so the fundamental frequency of the pulsation of the refrigerant and the natural frequency of each member forming the injection passage 31 are kept from coinciding with each other, and noise and also vibration are reduced.

A compressor pertaining to a seventh aspect of the invention is the compressor pertaining to the first aspect, wherein the length of the injection passage is set to a length that attenuates 70 Hz to 1400 Hz pulsation.

A compressor pertaining to an eighth aspect of the invention is the compressor pertaining to the first aspect to the fifth aspect, wherein the pulsation attenuation space is set to attenuate 70 Hz to 1400 Hz pulsation.

Advantageous Effects of Invention

In the compressor pertaining to the first aspect of the invention, the pulsation attenuation space communicates with the injection passage, so pulsation during injection is attenuated by the pulsation attenuation space. As a result, it is no longer necessary to provide a muffler or the like on the outer side of the compressor, and a suppression of pipe vibration and a reduction in cost can be achieved.

In the compressor pertaining to the second aspect of the invention, the refrigerant expands when it flows into the expansion chamber, so pulsation of the refrigerant is reduced as a result. That is to say, the expansion chamber fulfills a function as a muffler that suppresses pulsation of the refrigerant. Therefore, pulsation during injection is attenuated without providing a muffler or the like on the outer side of the compressor. As a result, a suppression of pipe vibration and a reduction in cost can be achieved.

In the compressor pertaining to the third aspect of the invention, the ratio of the flow path cross-sectional area of the expansion chamber to the flow path cross-sectional area of the injection port is in the range of 2.0 to 50, so the refrigerant pulsation attenuation effect is further enhanced.

In the compressor pertaining to the fourth aspect of the invention, in a case where the refrigerant flow direction bends in the expansion chamber, it becomes easier for the refrigerant to flow if the flow path cross section on the refrigerant outflow side of the expansion chamber and the flow path cross section of the injection port are not disposed on the same axis than if they are coaxial in their area centers. As a result, the effect of not only reducing pulsation with the expansion chamber but also of flow-through resistance being reduced is obtained.

In the compressor pertaining to the fifth aspect of the invention, the injection passage communicates with the pulsation attenuation space that is a Helmholtz space, so pulsation of the refrigerant in the injection passage is attenuated. As a result, noise and vibration caused by pulsation of the refrigerant are reduced, so the fundamental frequency of the pulsation of the refrigerant and the natural frequency of each member forming the injection passage are kept from coinciding with each other, and noise and also vibration are reduced.

In the compressor pertaining to the sixth aspect of the invention, the injection passage communicates with the pulsation attenuation space that is a side branch space, so pulsation of the refrigerant in the injection passage is attenuated. As a result, noise and vibration caused by pulsation of the refrigerant are reduced, so the fundamental frequency of the pressure pulsation of the refrigerant and the natural frequency of each member forming the injection passage are kept from coinciding with each other, and noise and also vibration are reduced.

In the compressor pertaining to the seventh aspect of the invention, the length of the injection passage is set to a length that attenuates 70 Hz to 1400 Hz pulsation, so the refrigerant pulsation attenuation effect is further enhanced.

In the compressor pertaining to the eighth aspect of the invention, the pulsation attenuation space is set to attenuate 70 Hz to 1400 Hz pulsation, so the refrigerant pulsation attenuation effect is further enhanced.

DESCRIPTION OF EMBODIMENT

An embodiment of the invention will be described below with reference to the drawings. It will be noted that the following embodiment is a specific example of the invention and is not intended to limit the technical scope of the invention.

Figure 1:
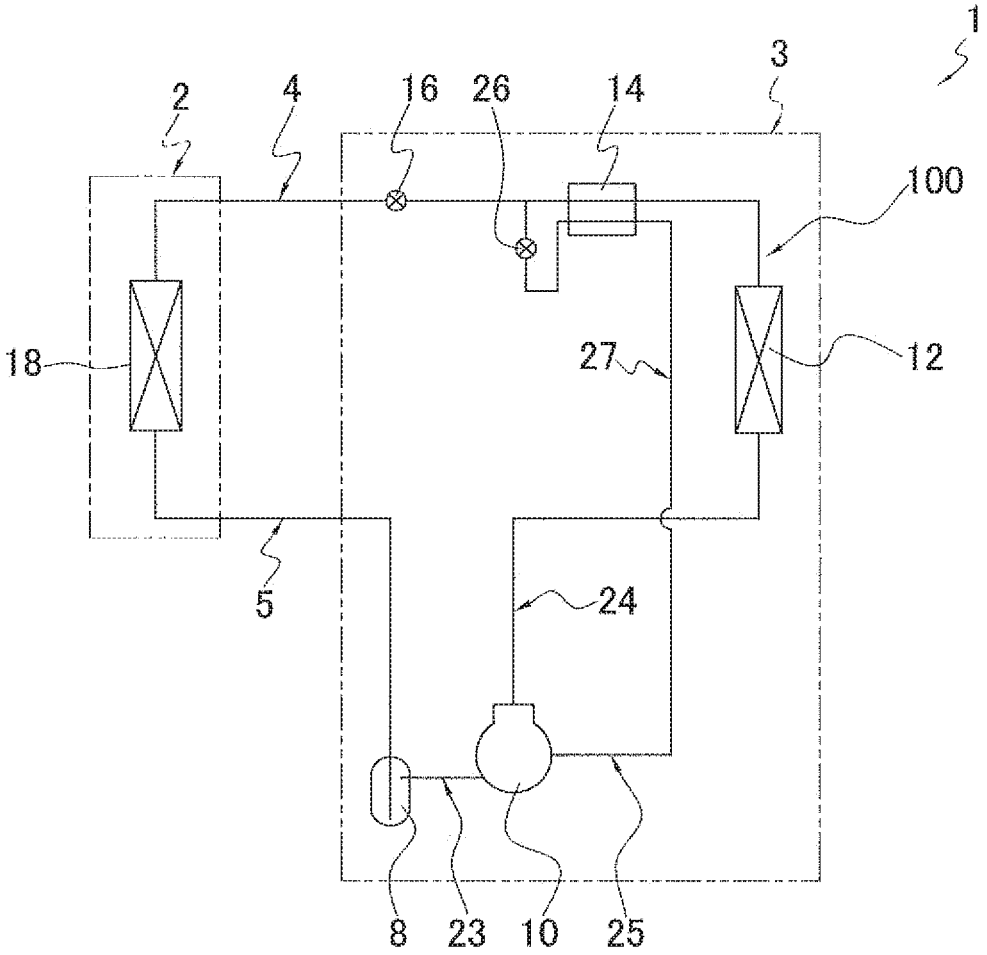
FIG. 1 is a refrigerant circuit diagram of an air conditioning system in which a scroll compressor pertaining to an embodiment of the invention is utilized.

(1) Overview of Air Conditioning System 1 in which Scroll Compressor 10 is Used FIG. 1 is a refrigerant circuit diagram of an air conditioning system 1 in which a scroll compressor 10 pertaining to the embodiment of the invention is used. Examples of the air conditioning system 1 in which the scroll compressor 10 is employed include a "cooling-only air conditioning system," a "heating-only air conditioning system," and an "air conditioning system switchable between cooling and heating using a four-way switching valve." Here, for convenience of description, the air conditioning system 1 will be described using a "cooling-only air conditioning system."

In FIG. 1, the air conditioning system 1 is equipped with an indoor unit 2 and an outdoor unit 3, and the indoor unit 2 and the outdoor unit 3 are connected to each other by a liquid refrigerant intercommunication pipe 4 and a gas refrigerant intercommunication pipe 5. As shown in FIG. 1, the air conditioning system 1 is a paired-type system having one each of the indoor unit 2 and the outdoor unit 3.

However, the air conditioning system 1 is not limited to this and may also be a multiple-type system having more than one indoor unit 2.

In the air conditioning system 1, a refrigerant circuit 100 is configured as a result of devices such as an accumulator 8, the scroll compressor 10, an outdoor heat exchanger 12, an economizer heat exchanger 14, an expansion valve 16, and an indoor heat exchanger 18 being connected to each other by pipes.

(1-1) Indoor Unit 2

The indoor heat exchanger 18 installed in the indoor unit 2 is a cross fin-type fin-and-tube heat exchanger configured by heat transfer tubes and numerous heat transfer fins. The liquid side of the indoor heat exchanger 18 is connected to the liquid refrigerant intercommunication pipe 4, the gas side of the indoor heat exchanger 18 is connected to the gas refrigerant intercommunication pipe 5, and the indoor heat exchanger 18 functions as a refrigerant evaporator.

(1-2) Outdoor Unit 3

The outdoor unit 3 is equipped with the accumulator 8, the scroll compressor 10, the outdoor heat exchanger 12, the economizer heat exchanger 14, the expansion valve 16, and an injection valve 26.

(1-2-1) Outdoor Heat Exchanger 12

The outdoor heat exchanger 12 is a cross fin-type fin-and-tube heat exchanger configured by heat transfer tubes and numerous heat transfer fins. One side of the outdoor heat exchanger 12 is connected to a discharge pipe 24 through which refrigerant discharged from the scroll compressor 10 flows, and the other side of the outdoor heat exchanger 12 is connected to the liquid refrigerant intercommunication pipe 4 side. The outdoor heat exchanger 12 functions as a condenser that condenses gas refrigerant supplied via the discharge pipe 24 from the scroll compressor 10.

(1-2-2) Economizer Heat Exchanger 14

The economizer heat exchanger 14, as shown in FIG. 1, is disposed between the outdoor heat exchanger 12 and the expansion valve 16. The economizer heat exchanger 14 causes heat exchange to take place between refrigerant that flows from the outdoor heat exchanger 12 toward the expansion valve 16 and refrigerant that flows through an injection refrigerant supply pipe 27 and whose pressure has been reduced by the injection valve 26.

(1-2-3) Injection Valve 26

The injection valve 26 is an electrically powered valve, whose opening degree is adjustable, for adjusting the pressure and flow rate of the refrigerant that is injected into the scroll compressor 10. The injection valve 26 is provided in the injection refrigerant supply pipe 27, which branches from a pipe interconnecting the outdoor heat exchanger 12 and the expansion valve 16. The injection refrigerant supply pipe 27 is a pipe that supplies refrigerant to an injection pipe 25 of the scroll compressor 10.

(1-2-4) Expansion Valve 16

The expansion valve 16 is provided in a pipe interconnecting the outdoor heat exchanger 12 and the liquid refrigerant intercommunication pipe 4. The expansion valve 16 is an electrically powered valve, whose opening degree is adjustable, for adjusting the pressure and flow rate of the refrigerant flowing through the pipe.

(1-2-5) Accumulator 8

The accumulator 8 is provided in a pipe interconnecting the gas refrigerant intercommunication pipe 5 and a suction pipe 23 of the scroll compressor 10. The accumulator 8 separates, into its gas phase and its liquid phase, the refrigerant heading from the indoor heat exchanger 18 via the gas refrigerant intercommunication pipe 5 to the suction pipe 23 to prevent liquid refrigerant from being supplied to the scroll compressor 10. The gas-phase refrigerant accumulating in the upper space of the accumulator 8 is supplied to the scroll compressor 10.

(1-2-6) Scroll Compressor 10

Figure 2:
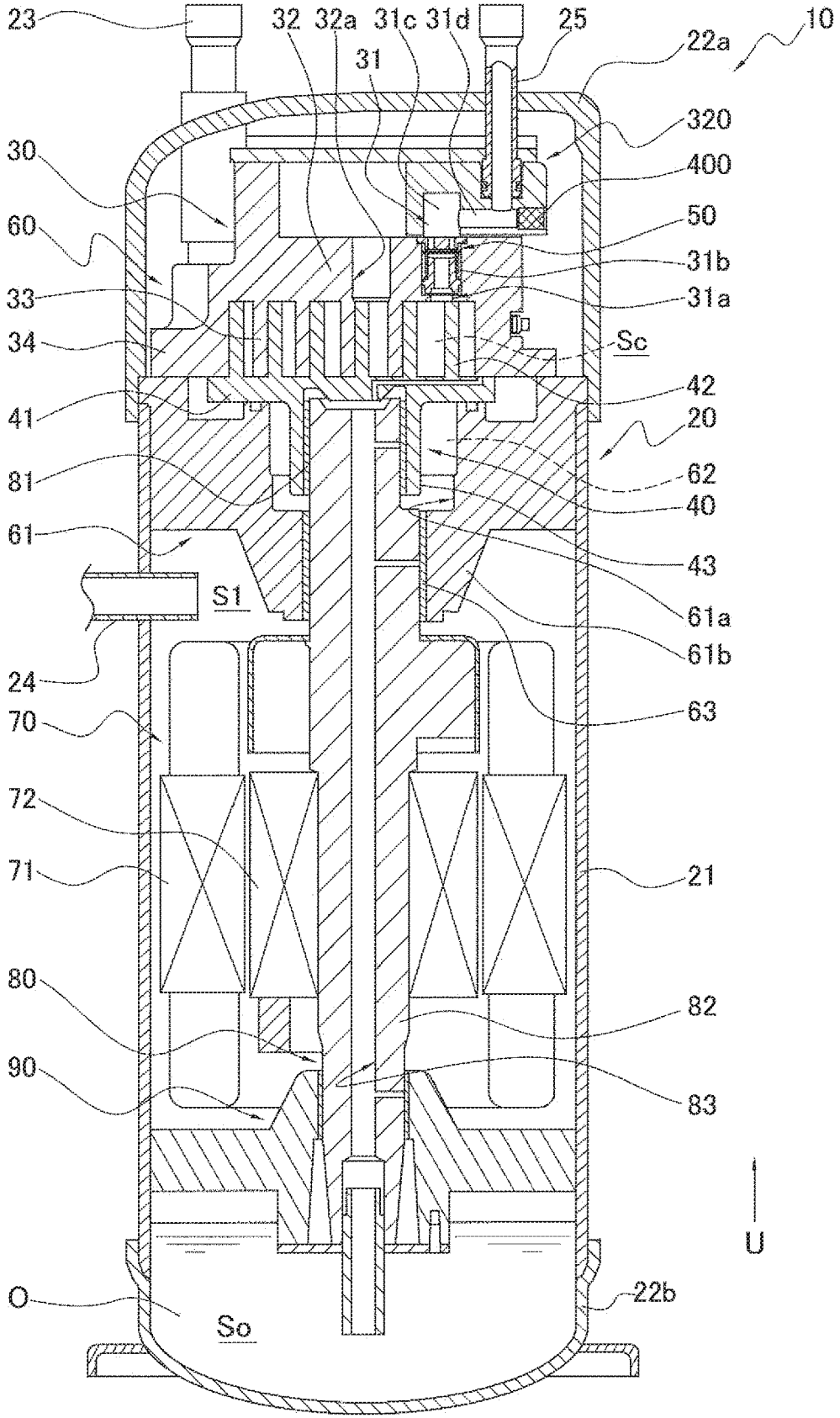
FIG. 2 is a longitudinal cross-sectional view of the scroll compressor pertaining to the embodiment of the invention.

FIG. 2 is a longitudinal cross-sectional view of the scroll compressor 10 pertaining to the embodiment of the invention. In FIG. 2, the scroll compressor 10 compresses, in a compression chamber Sc, refrigerant sucked in via the suction pipe 23 and discharges the refrigerant after compression from the discharge pipe 24. In the scroll compressor 10, intermediate injection, where some of the refrigerant flowing from the outdoor heat exchanger 12 toward the expansion valve 16 is supplied to the compression chamber Sc in the middle of compression, is performed.

(2) Detailed Description of Scroll Compressor 10

As shown in FIG. 2, the scroll compressor 10 is equipped with a casing 20, a scroll compression mechanism 60 including a fixed scroll 30, a drive motor 70, a crankshaft 80, and a lower bearing 90. Furthermore, the scroll compressor 10 is also equipped with a check valve 50, which is provided in an injection passage 31 formed in the fixed scroll 30, and the injection pipe 25, which supplies refrigerant to the injection passage 31.

Below, there are cases where expressions such as "upper" and "lower" are used to describe positional relationships of constituent members, and here the direction of arrow U in FIG. 2 will be called "upper" and the opposite direction of arrow U will be called "lower". Furthermore, there are cases where expressions such as "vertical," "horizontal," "longitudinal," and "transverse" are used, and the vertical direction and the longitudinal direction coincide with the up and down direction.

(2-1) Casing 20

The scroll compressor 10 has the casing 20, which is shaped like a vertically long open cylinder. The casing 20 has an open cylinder member 21, which is substantially shaped like an open cylinder whose top and bottom and open, and an upper lid 22*a* and a lower lid 22*b*, which are provided on the upper end and lower end, respectively, of the open cylinder member 21. The upper lid 22*a* and the lower lid 22*b* are secured by welding to the open cylinder member 21 so as to be airtight.

Housed in the casing 20 are constituent devices of the scroll compressor 10 including the scroll compression mechanism 60, the drive motor 70, the crankshaft 80, and the lower bearing 90. Furthermore, an oil collection space So is formed in the lower portion of the casing 20. Refrigerating machine oil O for lubricating the scroll compression mechanism 60 and so forth is collected in the oil collection space So.

In the upper portion of the casing 20, the suction pipe 23, which sucks in gas refrigerant and supplies the gas refrigerant to the scroll compression mechanism 60, is provided running through the upper lid 22*a*. The lower end of the suction pipe 23 is connected to the fixed scroll 30 of the scroll compression mechanism 60. The suction pipe 23 communicates with the compression chamber Sc of the scroll compression mechanism 60. Refrigerant at a low pressure in the refrigeration cycle prior to compression by the scroll compressor 10 flows in the suction pipe 23.

The discharge pipe 24, through which refrigerant discharged to the outside of the casing 20 travels, is provided in an intermediate portion of the open cylinder member 21 of the casing 20. More specifically, the discharge pipe 24 is disposed in such a way that the end portion of the discharge pipe 24 inside the casing 20 projects into a high-pressure space S1 formed below a housing 61 of the scroll compression mechanism 60. Refrigerant at a high pressure in the refrigeration cycle after compression by the scroll compression mechanism 60 flows in the discharge pipe 24.

In the upper surface of the upper lid 22*a* of the casing 20, the injection pipe 25 is provided running through the side surface of the upper lid 22*a*. The end portion of the injection pipe 25 outside the casing 20 is, as shown in FIG. 1, connected to the injection refrigerant supply pipe 27.

The injection pipe 25 supplies refrigerant to the injection passage 31 formed in the fixed scroll 30. The injection passage 31 communicates with the compression chamber Sc of the scroll compression mechanism 60, and the refrigerant supplied from the injection pipe 25 is supplied via the injection passage 31 to the compression chamber Sc. Refrigerant at a pressure (intermediate pressure) between the low pressure and the high pressure in the refrigeration cycle is supplied from the injection pipe 25 to the injection passage 31. Details regarding the injection passage 31 will be described in the latter half.

(2-2) Scroll Compression Mechanism 60

The scroll compression mechanism 60, as shown in FIG. 2, mainly has the housing 61, the fixed scroll 30 disposed above the housing 61, and a movable scroll 40 that forms the compression chamber Sc in combination with the fixed scroll 30.

(2-2-1) Fixed Scroll 30

As shown in FIG. 2, the fixed scroll 30 has a fixed-side end plate 32 that is shaped like a flat plate, a fixed-side wrap 33 that is shaped like a spiral and projects from the front surface (the lower surface in FIG. 2) of the fixed-side end plate 32, and an outer edge portion 34 that surrounds the fixed-side wrap 33.

In the central portion of the fixed-side end plate 32, a noncircular-shaped discharge opening 32*a* that communicates with the compression chamber Sc of the scroll compression mechanism 60 is formed running through the fixed-side end plate 32 in the thickness direction. Refrigerant compressed in the compression chamber Sc is discharged from the discharge opening 32*a*, travels through a non-illustrated refrigerant passage formed in the fixed scroll 30 and the housing 61, and flows into the high-pressure space S1.

Furthermore, an injection pipe connection head 320, to which one end of the injection pipe 25 is connected, is secured to the fixed-side end plate 32. An injection pipe connection portion 321 and a horizontal passage portion 31*d* through which the refrigerant supplied from the injection pipe 25 travels are formed in the injection pipe connection head 320.

(2-2-2) Movable Scroll 40

The movable scroll 40, as shown in FIG. 2, has a movable-side end plate 41 that is shaped like a flat plate, a movable-side wrap 42 that is shaped like a spiral and projects from the front surface (the upper surface in FIG. 2) of the movable-side end plate 41, and a boss portion 43 formed in the shape of an open cylinder that projects from the back surface (the lower surface in FIG. 2) of the movable-side end plate 41.

The fixed-side wrap 33 of the fixed scroll 30 and the movable-side wrap 42 of the movable scroll 40 are put together in a state in which the lower surface of the fixed-side end plate 32 and the upper surface of the movable-side end plate 41 oppose each other. The compression chamber Sc is formed between the fixed-side wrap 33 and the movable-side wrap 42 which are adjacent to each other. When the movable scroll 40 orbits relative to the fixed scroll 30 as described later, the volume of the compression chamber Sc periodically changes, and suction, compression, and discharge of the refrigerant are carried out in the scroll compression mechanism 60.

The boss portion 43 is a part shaped like an open cylinder whose upper end is closed off. The movable scroll 40 and the crankshaft 80 are coupled to each other as a result of an eccentric portion 81 of the crankshaft 80 being inserted into the hollow portion of the boss portion 43. The boss portion 43 is disposed in an eccentric portion space 62 formed between the movable scroll 40 and the housing 61. The eccentric portion space 62 communicates, via an oil supply path 83 of the crankshaft 80 and so forth, with the high-pressure space S1, and high pressure acts on the eccentric portion space 62. Because of this pressure, the lower surface of the movable-side end plate 41 inside the eccentric portion space 62 is pushed upward toward the fixed scroll 30. Because of this force, the movable scroll 40 is in close contact with the fixed scroll 30.

The movable scroll 40 is supported by the housing 61 via a non-illustrated Oldham coupling. The Oldham coupling is a member that prevents self-rotation of the movable scroll 40 and allows the movable scroll 40 to orbit. By using the Oldham coupling, when the crankshaft 80 rotates, the movable scroll 40 coupled to the crankshaft 80 at the boss portion 43 orbits without self-rotating relative to the fixed scroll 30 and the refrigerant in the compression chamber Sc is compressed.

(2-2-3) Housing 61

The housing 61 is press-fitted into the open cylinder member 21 and, at its outer peripheral surface, is secured all the way around in the circumferential direction to the open cylinder member 21. Furthermore, the housing 61 and the fixed scroll 30 are secured to each other by non-illustrated bolts or the like so that the upper end surface of the housing 61 is in close contact with the lower surface of the outer edge portion 34 of the fixed scroll 30.

In the housing 61 are formed a recess portion 61*a*, which is disposed so as to be recessed in the central portion of the upper surface of the housing 61, and a bearing portion 61*b*, which is disposed below the recess portion 61*a*.

The recess portion 61*a* surrounds the side surface of the eccentric portion space 62 in which the boss portion 43 of the movable scroll 40 is disposed.

A bearing 63 that pivotally supports a main shaft 82 of the crankshaft 80 is disposed in the bearing portion 61*b*. The bearing 63 supports the main shaft 82 inserted into the bearing 63 in such a way that the main shaft 82 may freely rotate.

(2-3) Drive Motor 70

The drive motor 70 has an annular stator 71 secured to the inner wall surface of the open cylinder member 21 and a rotor 72 housed on the inner side of the stator 71 with a slight gap (an air gap passage) between them and in such a way that the rotor 72 may freely rotate.

The rotor 72 is coupled to the movable scroll 40 via the crankshaft 80, which is disposed so as to extend in the up and down direction along the axial center of the open cylinder member 21. When the rotor 72 rotates, the movable scroll 40 orbits relative to the fixed scroll 30.

(2-4) Crankshaft 80

The crankshaft 80 transmits the driving force of the drive motor 70 to the movable scroll 40. The crankshaft 80 is disposed so as to extend in the up and down direction along the axial center of the open cylinder member 21, and couples the rotor 72 of the drive motor 70 to the movable scroll 40 of the scroll compression mechanism 60.

The crankshaft 80 has the main shaft 82, whose central axis coincides with the axial center of the open cylinder member 21, and the eccentric portion 81, which is eccentric relative to the axial center of the open cylinder member 21. The eccentric portion 81 is inserted into the boss portion 43 of the movable scroll 40 as mentioned earlier.

The main shaft 82 is supported, in such a way that it may freely rotate, by the bearing 63 in the bearing portion 61*b* of the housing 61 and the lower bearing 90. The main shaft 82 is coupled to the rotor 72 of the drive motor 70 between the bearing portion 61*b* and the lower bearing 90.

The oil supply path 83 for supplying the refrigerating machine oil O to the scroll compression mechanism 60 and so forth is formed inside the crankshaft 80. The lower end of the main shaft 82 is positioned in the oil collection space So formed in the lower portion of the casing 20, and the refrigerating machine oil O in the oil collection space So is supplied through the oil supply path 83 to the scroll compression mechanism 60 and so forth.

(2-5) Lower Bearing 90

The lower bearing 90 is disposed below the drive motor 70. The lower bearing 90 is secured to the open cylinder member 21. The lower bearing 90 configures a bearing on the lower end side of the crankshaft 80 and supports the main shaft 82 of the crankshaft 80 in such a way that the main shaft 82 may freely rotate.

(3) Operation of Scroll Compressor 10

The operation of the scroll compressor 10 will be described. When the drive motor 70 starts up, the rotor 72 rotates relative to the stator 71, and the crankshaft 80 secured to the rotor 72 rotates. When the crankshaft 80 rotates, the movable scroll 40 coupled to the crankshaft 80 orbits relative to the fixed scroll 30. Additionally, gas refrigerant at a low pressure in the refrigeration cycle is sucked through the suction pipe 23 from the peripheral edge side of the compression chamber Sc into the compression chamber Sc. As the movable scroll 40 orbits, the suction pipe 23 and the compression chamber Sc no longer communicate with each other, and as the capacity of the compression chamber Sc decreases, the pressure in the compression chamber Sc starts to rise.

Refrigerant is injected from an injection port 31*a* into the compression chamber Sc in the middle of compression. It will be noted that in a case where the pressure of the refrigerant supplied from the injection refrigerant supply pipe 27 (see FIG. 1) to the injection pipe 25 is higher than the pressure in the compression chamber Sc to which the injection port 31*a* opens, the refrigerant is supplied from the injection pipe 25 via the injection passage 31 to the compression chamber Sc. On the other hand, when the pressure of the refrigerant supplied from the injection refrigerant supply pipe 27 to the injection pipe 25 becomes lower than the pressure in the compression chamber Sc to which the injection port 31*a* opens, the check valve 50 functions to cut off the flow of the refrigerant from the compression chamber Sc to the injection pipe 25.

As the compression of the refrigerant proceeds, the compression chamber Sc no longer communicates with the injection port 31*a*. The refrigerant in the compression chamber Sc is compressed as the capacity of the compression chamber Sc decreases, and eventually the refrigerant becomes high-pressure gas refrigerant. The high-pressure gas refrigerant is discharged from the discharge opening 32*a* positioned near the center of the fixed-side end plate 32. Thereafter, the high-pressure gas refrigerant travels through the non-illustrated refrigerant passage formed in the fixed scroll 30 and the housing 61 and flows into the high-pressure space S1. The gas refrigerant at a high pressure in the refrigeration cycle after compression by the scroll compression mechanism 60 that has flowed into the high-pressure space S1 is discharged from the discharge pipe 24.

(4) Structure of Area Around Injection Passage 31

Figure 3:
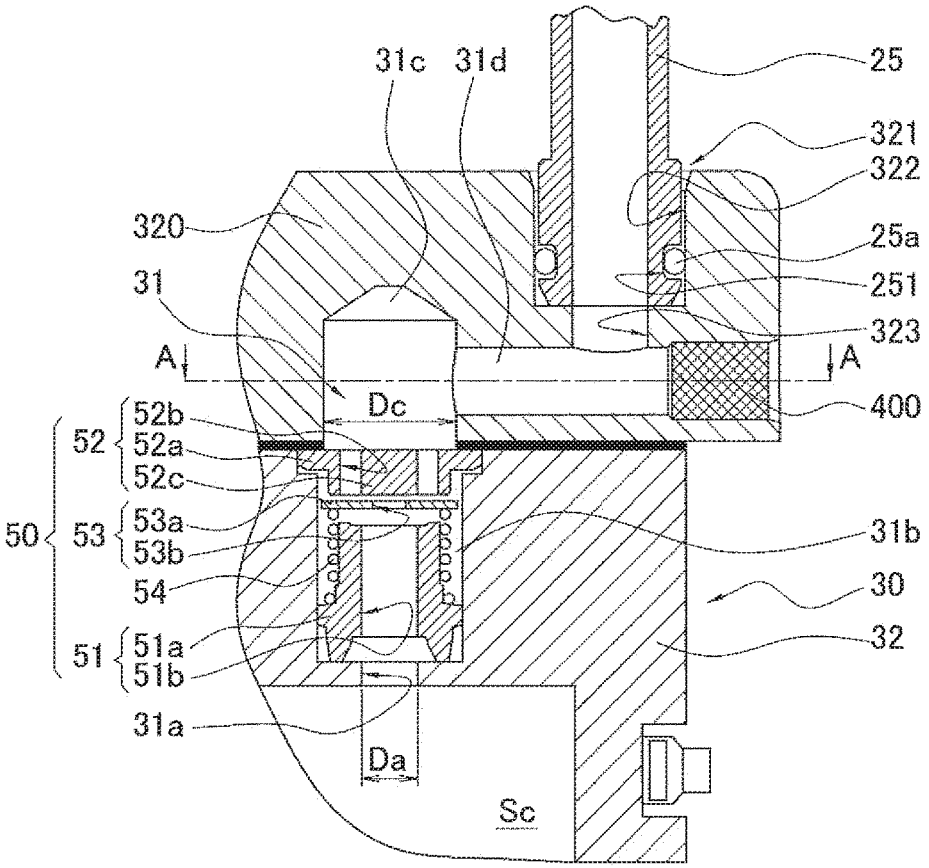
FIG. 3 is an enlarged view of the area around an injection passage in FIG. 2.

FIG. 3 is an enlarged view of the area around the injection passage in FIG. 2. In FIG. 3, the injection passage 31 includes the injection port 31*a* provided in the lower surface of the fixed-side end plate 32, a valve chamber 31*b* provided between the injection port 31*a* and the upper surface of the fixed-side end plate 32, an expansion chamber 31*c* provided above the valve chamber 31*b*, and a horizontal passage portion 31*d* that horizontally communicates the expansion chamber 31*c* to the injection pipe connection portion 321.

(4-1) Injection Port 31*a*

The injection port 31*a* is a circular hole and directly communicates the valve chamber 31*b* to the compression chamber Sc.

When the drive motor 70 is started up and the crankshaft 80 rotates and the movable scroll 40 orbits relative to the fixed scroll 30, the capacity of the compression chamber Sc changes and the pressure in the compression chamber Sc with which the injection port 31*a* communicates changes.

In a case where the pressure of the refrigerant supplied from the injection refrigerant supply pipe 27 (see FIG. 1) to the injection pipe 25 is higher than the pressure in the compression chamber Sc to which the injection port 31*a* opens, the refrigerant is supplied via the injection pipe 25, the horizontal passage portion 31*d*, and the injection port 31*a* to the compression chamber Sc.

On the other hand, in a case where the pressure of the refrigerant supplied from the injection refrigerant supply pipe 27 to the injection pipe 25 is lower than the pressure in the compression chamber Sc to which the injection port 31*a* opens, the flow of the refrigerant heading from the compression chamber Sc to the injection pipe 25 is cut off by the check valve 50 provided in the valve chamber 31*b*.

(4-2) Valve Chamber 31*b*

In the valve chamber 31*b* is disposed the check valve 50. The check valve 50 does not cut off the flow of the refrigerant in a case where the pressure of the refrigerant supplied from the injection refrigerant supply pipe 27 (see FIG. 1) to the injection pipe 25 is higher than the pressure in the compression chamber Sc to which the injection port 31*a* opens, that is to say, when the refrigerant flows from the injection pipe 25 to the compression chamber Sc.

On the other hand, the check valve 50 cuts off the flow of the refrigerant in a case where the pressure of the refrigerant supplied from the injection refrigerant supply pipe 27 to the injection pipe 25 is lower than the pressure in the compression chamber Sc to which the injection port 31*a* opens, that is to say, when the refrigerant tries to flow from the compression chamber Sc to the injection pipe 25.

As shown in FIG. 3, the check valve 50 has a first valve seat 51, a second valve seat 52, a valve body 53, and a spring 54.

(4-2-1) First Valve Seat 51

The first valve seat 51 is a tubular member that is press-fitted into the lower portion of the valve chamber 31*b*. The outer diameter dimension of part of the first valve seat 51 is set such that that section can be press-fitted into the lower portion of the valve chamber 31*b*, and that section will be called a press-fitted portion 51*a*. The outer periphery of the first valve seat 51 other than the press-fitted portion 51*a* is set to an outer diameter such that a gap is formed between that outer periphery and the inner peripheral surface of the valve chamber 31*b*. The central portion of the first valve seat 51 is provided with a through hole 51*b* so that the refrigerant can flow through.

(4-2-2) Second Valve Seat 52

The second valve seat 52 is a closed cylindrical member that is press-fitted into the upper portion of the valve chamber 31*b*. The outer diameter dimension of part of the second valve seat 52 is set such that that section can be press-fitted into the upper portion of the valve chamber 31*b*, and that section will be called a press-fitted portion 52*a*. The outer periphery of the second valve seat 52 other than the press-fitted portion 52*a* is set to an outer diameter such that a gap is formed between that outer periphery and the inner peripheral surface of the valve chamber 31*b*.

Figure 4A:
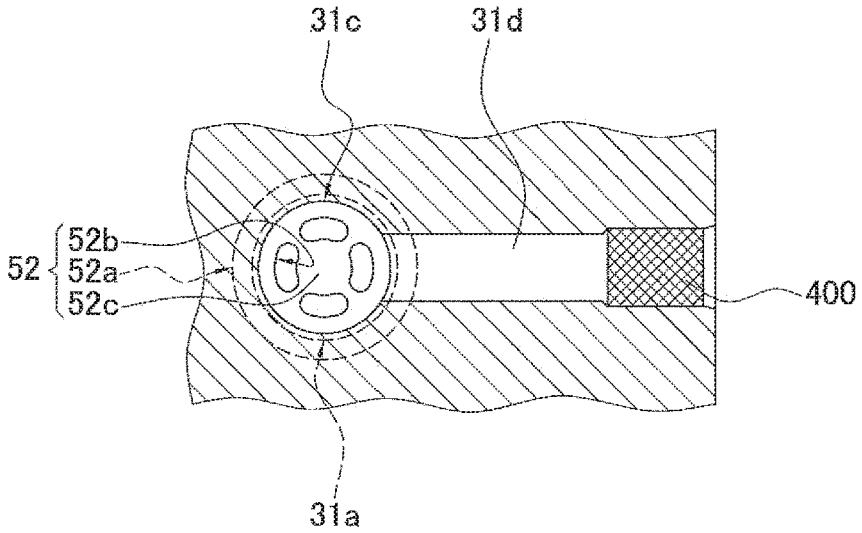
FIG. 4A is a cross-sectional view seen from arrows A-A of FIG. 3.

FIG. 4A is a cross-sectional view seen from arrows A-A of FIG. 3. In FIG. 4A, the second valve seat 52 is provided with four flow-through holes 52*b* surrounding the central axis of the second valve seat 52 in positions a predetermined distance away from the central axis. The four flow-through holes 52*b* are disposed at 90° intervals so as to surround the central axis. It will be noted that the section surrounded by the four flow-through holes 52*b* will be called a central portion 52*c*.

The total of the flow path areas of the four flow-through holes 52*b* is larger than the flow path area of the injection port 31*a*. It will be noted that FIG. 3 shows the cross sections of two flow-through holes 52*b* out of the four flow-through holes 52*b*.

(4-2-3) Valve Body 53

The valve body 53 is a disc member and is disposed so as to be movable up and down in a space formed between the first valve seat 51 and the second valve seat 52 in the valve chamber 31*b*. Consequently, when the valve body 53 moves downward, the valve body 53 hits the first valve seat 51 and stops, and when the valve body 53 moves upward, the valve body 53 hits the second valve seat 52 and stops.

A circular escape hole 53*b* is formed in the central portion of the valve body 53. Consequently, the valve body 53 fulfills, with the escape hole 53*b* and an annular peripheral edge portion 53*a* that annularly surrounds the escape hole 53*b*, the function of a valve.

The outer diameter dimension of the valve body 53 is set to a dimension such that the valve body 53 can move in the vertical direction along the inner peripheral surface of the valve chamber 31*b*. Furthermore, the hole diameter of the escape hole 53*b* is set to a dimension such that, even if the valve body 53 is off-center in the radial direction, there is no overlap between the escape hole 53*b* and any of the four flow-through holes 52*b* in the second valve seat 52. That is to say, even if the valve body 53 is pressed against the second valve seat 52 in a state in which the valve body 53 is off-center in the radial direction, there is no overlap between the escape hole 53*b* and any of the four flow-through holes 52*b* in the second valve seat 52, and the escape hole 53*b* in the valve body 53 is blocked off by the central portion 52*c* of the second valve seat 52.

(4-2-4) Spring 54

The spring 54 is a compression coil spring and is inserted in the gap formed between the outer periphery of the first valve seat 51 other than the press-fitted portion 51*a* and the inner peripheral surface of the valve chamber 31*b*. Furthermore, the spring 54 is disposed in a compressed state so that force in the direction in which the spring 54 presses the valve body 53 against the second valve seat 52 side acts on the valve body 53.

(4-3) Expansion Chamber 31*c*

The expansion chamber 31*c* is positioned above the valve chamber 31*b* and communicates the valve chamber 31*b* to the horizontal passage portion 31*d*. The inside of the expansion chamber 31*c* is a hollow open cylinder, and an inner diameter Dc thereof is larger than an inner diameter Da of the injection port 31*a* and an inner diameter Db of the through hole 51*b* in the first valve seat 51, in the present embodiment, the inner diameter Dc is set in the range of 2.0 to 50 in an area ratio conversion.

The expansion chamber 31*c* is provided for the purpose of attenuating pulsation that occurs during injection, and the target frequency to be attenuated is 70 Hz to 1400 Hz.

Figure 4B:
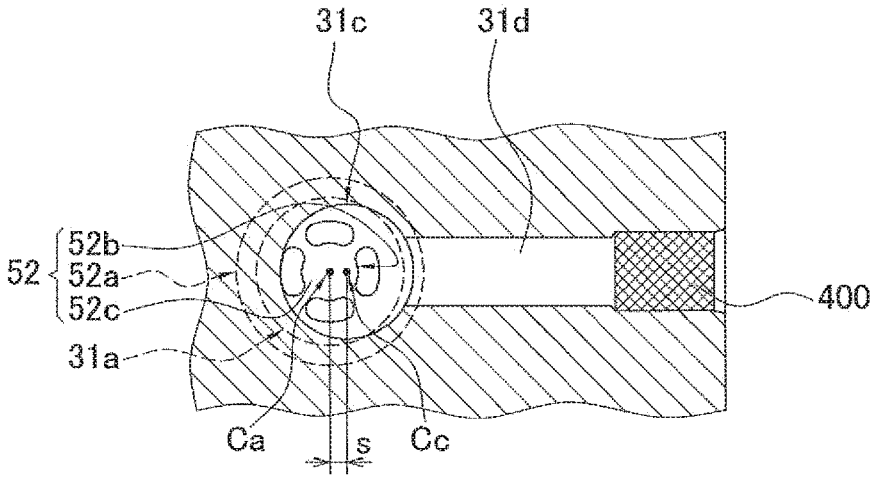
FIG. 4B is an imaginary cross-sectional view in which an expansion chamber in FIG. 4A has been horizontally moved.

In FIG. 3 and FIG. 4A, the center of the expansion chamber 31*c* is disposed on the same axis as the centers of the injection port 31*a* and the valve chamber 31*b*, but the position of the center of the expansion chamber 31*c* is not limited to this. For example, as shown in FIG. 4B, a center Cc of the expansion chamber 31*c* may also be shifted a predetermined distance s toward the horizontal passage portion 31*d* from a center Ca of the injection port 31*a* so that it becomes easier for the refrigerant to flow from the horizontal passage portion 31*d* to the valve chamber 31*b*.

(4-4) Horizontal Passage Portion 31*d*

One end of the horizontal passage portion 31*d* communicates with the injection pipe connection portion 321, and the other end of the horizontal passage portion 31*d* communicates with the expansion chamber 31*c*. The horizontal passage portion 31*d* guides, to the expansion chamber 31*c*, the refrigerant supplied from the injection pipe 25 connected to the injection pipe connection portion 321.

The horizontal passage portion 31*d* is formed by boring a hole from the side surface of the injection pipe connection head 320, so after assembly the open end is plugged with a plug 400.

(4-5) Injection Pipe Connection Portion 321

The injection pipe connection portion 321 has a large-diameter hole portion 322, to which one end of the injection pipe 25 is connected, and a small-diameter hole portion 323, whose diameter is smaller than that of the large-diameter hole portion 322 and whose flow path area is set to be substantially the same as that of the horizontal passage portion 31*d*. The small-diameter hole portion 323 communicates with the horizontal passage portion 31*d*.

(4-6) Injection Pipe 25

The injection pipe 25 is inserted into the large-diameter hole portion 322 of the injection pipe connection portion 321. A circumferential groove 251 is formed in the outer periphery of the insertion end of the injection pipe 25, and an O-ring 25*a* is fitted in the circumferential groove 251.

The insertion end of the injection pipe 25 is inserted into the large-diameter hole portion 322 of the injection pipe connection portion 321, whereby the O-ring 25*a* is compressed and is in close contact with the inner peripheral surface of the large-diameter hole portion 322.

(5) Behavior of Refrigerant During Injection

The refrigerant supplied from the injection pipe 25 fills the small-diameter hole portion 323 of the injection pipe connection portion 321, the horizontal passage portion 31*d*, the expansion chamber 31*c*, and the flow-through holes 52*b* in the second valve seat 52 in the valve chamber 31*b*.

Then, when the pressure of the refrigerant supplied from the injection pipe 25 becomes higher than the pressure in the compression chamber Sc to which the injection port 31*a* opens, the annular peripheral edge portion 53*a* of the valve body 53 opposing the four flow-through holes 52*b* is pushed by the refrigerant pressure, and the valve body 53 moves toward the first valve seat 51.

When the valve body 53 contacts the first valve seat 51, the movement of the valve body 53 is regulated by the first valve seat 51, so the valve body 53 is pushed against the first valve seat 51 by the refrigerant that has traveled through the flow-through holes 52*b*. Then, the refrigerant that has traveled through the flow-through holes 52*b* travels through the escape hole 53*b* in the valve body 53, the through hole 51*b* in the first valve seat 51, and the injection port 31*a* and flows into the compression chamber Sc.

On the other hand, in a state in which the pressure of the refrigerant supplied from the injection pipe 25 is lower than the pressure in the compression chamber Sc to which the injection port 31*a* opens, the valve body 53 moves toward the second valve seat 52 and is pushed against the second valve seat 52 by the flow of the refrigerant flowing from the compression chamber Sc toward the injection pipe 25.

In this state, the flow-through holes 52*b* are closed off by the annular peripheral edge portion 53*a* of the valve body 53 opposing the flow-through holes 52*b*. That is to say, when the check valve 50 stops the backflow of the refrigerant, the flow-through holes 52*b* are closed off by the annular peripheral edge portion 53*a*, whereby the refrigerant that has flowed in from the compression chamber Sc is regulated from traveling through the flow-through holes 52*b* toward the injection pipe 25.

Pulsation occurs because of the behavior of the refrigerant described above. In the conventional configuration, this pulsation during injection has caused the pipes to vibrate, but in the present embodiment, the expansion chamber 31*c*, which is an open cylindrical space whose diameter is larger than the diameter of the injection port 31*a*, is interposed in the middle of the injection passage 31, namely, between the valve chamber 31*b* and the horizontal passage portion 31*d*, so the refrigerant expands when it flows into the expansion chamber 31*c*, and pulsation of the refrigerant is reduced. That is to say, the expansion chamber 31*c* fulfills a function as a muffler that suppresses pulsation of the refrigerant.

As described above, according to the present embodiment, pulsation during injection is attenuated without providing a muffler or the like on the outer side of the scroll compressor 10. As a result, a suppression of pipe vibration and a reduction in cost can be achieved.

(6) Characteristics (6-1)

In the scroll compressor 10, the expansion chamber 31*c* communicates with the injection passage 31, so the refrigerant expands when it flows into the expansion chamber 31*c*, and pulsation of the refrigerant is reduced as a result. Furthermore, the ratio of the flow path cross-sectional area of the expansion chamber 31*c* to the flow path cross-sectional area of the injection port 31*a* is in the range of 2.0 to 50, so the refrigerant pulsation attenuation effect is further enhanced. Therefore, pulsation during injection is attenuated without providing a muffler or the like on the outer side of the scroll compressor 10. As a result, a suppression of pipe vibration and a reduction in cost can be achieved.

(6-2)

In the scroll compressor 10, in a case where the refrigerant flow direction bends in the expansion chamber 31*c*, a method can be employed where the flow path cross section on the refrigerant outflow side of the expansion chamber 31*c* and the flow path cross section of the injection port 31*a* are not disposed on the same axis in their area centers. This is because it becomes easier for the refrigerant to flow, so the effect of not only reducing pulsation with the expansion chamber 31*c* but also of flow-through resistance being reduced is obtained.

(7) Example Modifications

The above embodiment attenuates pulsation during injection by providing the expansion chamber 31*c* in the middle of the injection passage 31 by which the refrigerant supplied from the injection pipe 25 reaches the injection port 31*a*. However, the pulsation attenuation method is not limited to this and may also be a structure provided with a Helmholtz resonator or a side branch resonator.

(7-1) First Example Modification

Figure 5:
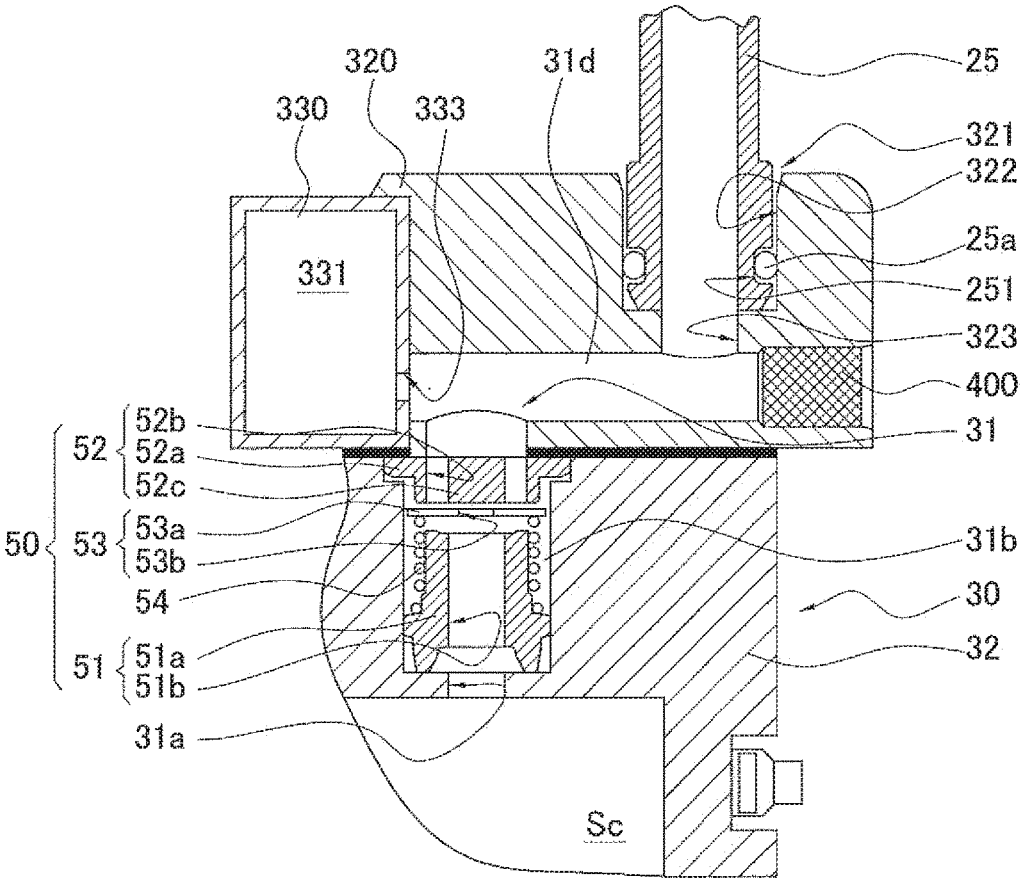
FIG. 5 is an enlarged view of the area around the injection passage in a first example modification.

FIG. 5 is an enlarged view of the area around the injection passage in a first example modification. The scroll compressor 10 pertaining to the first example modification in FIG. 5 differs from the one in the above embodiment shown in FIG. 2 and FIG. 3 in that, instead of the expansion chamber 31*c*, a Helmholtz resonator 330 is disposed adjacent to the horizontal passage portion 31*d*. Consequently, configurations other than the resonator 330 are substantially the same as those in the above embodiment, so here just the resonator 330 and the section around the resonator 330 will be described.

In the first example modification, the Helmholtz resonator 330 is connected to the injection passage 31 leading from the injection pipe 25 to the compression chamber Sc. Specifically, the resonator 330 is connected so as to be adjacent to a branching region for branching from the horizontal passage portion 31*d* to the valve chamber 31*b*.

As shown in FIG. 5, the resonator 330 comprises an inner chamber 331 having a predetermined capacity and a hole portion 333 having a predetermined diameter and a predetermined length, and the inner chamber 331 communicates with the horizontal passage portion 31*d* via the hole portion 333.

The refrigerant supplied from the injection pipe 25 fills the small-diameter hole portion 323 of the injection pipe connection portion 321, the horizontal passage portion 31*d*, and the flow-through holes 52*b* in the second valve seat 52 in the valve chamber 31*b*. Moreover, the inner chamber 331 of the resonator 330 is filled with refrigerant that flows in via the hole portion 333.

Additionally, when the pressure of the refrigerant supplied from the injection pipe 25 becomes higher than the pressure in the compression chamber Sc to which the injection port 31*a* opens, the check valve 50 opens and the refrigerant flows into the compression chamber Sc from the injection port 31*a*. On the other hand, when the pressure of the refrigerant supplied from the injection pipe 25 becomes lower than the pressure in the compression chamber Sc to which the injection port 31*a* opens, the check valve 50 closes.

This behavior of the refrigerant gives rise to pressure pulsation. In the conventional configuration, this pulsation during injection has caused the pipes to vibrate. However, in this first example modification, pressure pulsation of the refrigerant in the injection passage 31 can be attenuated.

Furthermore, because noise and vibration caused by pressure pulsation of the refrigerant are reduced, the fundamental frequency of the pressure pulsation of the refrigerant and the natural frequency of each member forming the injection passage 31 are kept from coinciding with each other, and noise and also vibration are reduced.

(7-2) Second Example Modification

Figure 6:
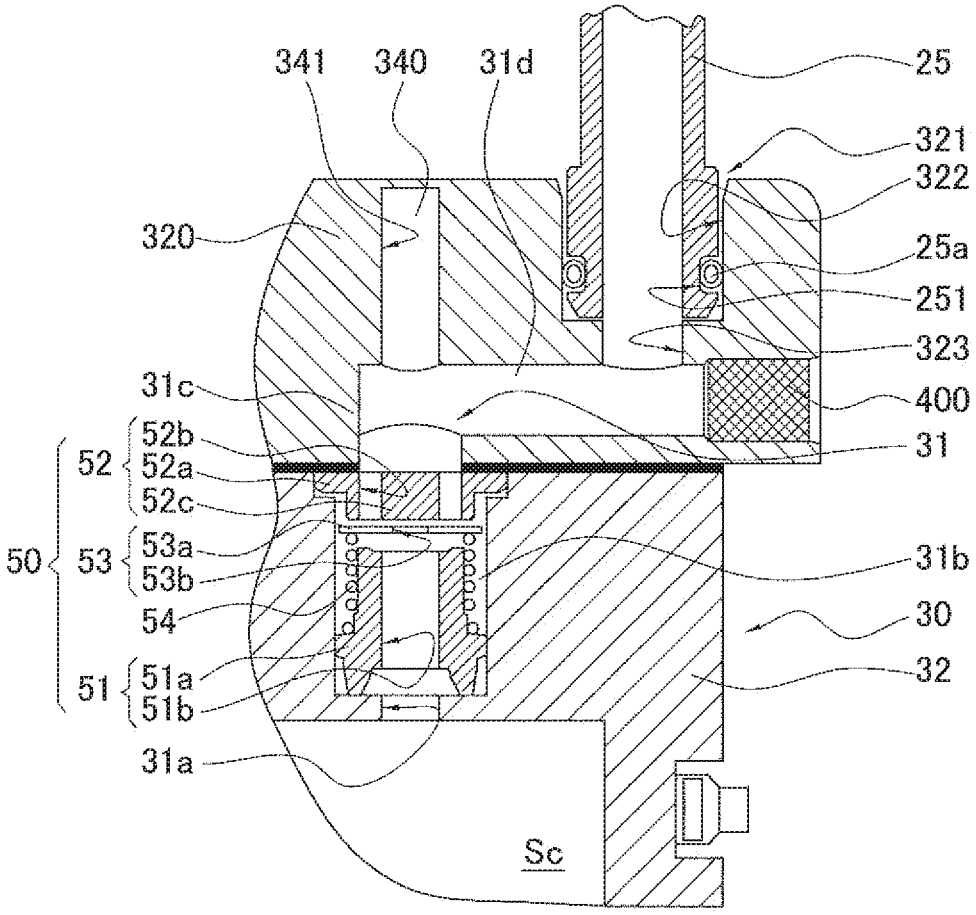
FIG. 6 is an enlarged view of the area around the injection passage in a second example modification.

FIG. 6 is an enlarged view of the area around the injection passage in a second example modification. The scroll compressor 10 pertaining to the second example modification in FIG. 6 differs from the one in the above embodiment shown in FIG. 2 and FIG. 3 in that, instead of the expansion chamber 31*c*, a side branch resonator 340 is disposed adjacent to the horizontal passage portion 31*d*. Consequently, configurations other than the side branch resonator 340 are substantially the same as those in the above embodiment, so here just the side branch resonator 340 and the section around the side branch resonator 340 will be described.

In the second example modification, the side branch resonator 340 branches from and is connected to the injection passage 31 leading from the injection pipe 25 to the compression chamber Sc. Specifically, the resonator 340 is connected so as to branch from the horizontal passage portion 31*d* on the opposite side of the valve chamber 31*b* across a branching region for branching from the horizontal passage portion 31*d* to the valve chamber 31*b*. As shown in FIG. 6, the resonator 340 forms a bottomed hole 341 having a predetermined diameter and a predetermined length.

The refrigerant supplied from the injection pipe 25 fills the small-diameter hole portion 323 of the injection pipe connection portion 321, the horizontal passage portion 31*d*, and the flow-through holes 52*b* in the second valve seat 52 in the valve chamber 31*b*. Moreover, the resonator 340 is also filled with refrigerant from the horizontal passage portion 31*d*.

Additionally, when the pressure of the refrigerant supplied from the injection pipe 25 becomes higher than the pressure in the compression chamber Sc to which the injection port 31*a* opens, the check valve 50 opens and the refrigerant flows into the compression chamber Sc from the injection port 31*a*. On the other hand, when the pressure of the refrigerant supplied from the injection pipe 25 becomes lower than the pressure in the compression chamber Sc to which the injection port 31*a* opens, the check valve 50 closes.

This behavior of the refrigerant gives rise to pressure pulsation. In the conventional configuration, this pulsation during injection has caused the pipes to vibrate. However, in this second example modification, the pressure pulsation of the refrigerant in the injection passage 31 can be attenuated.

Furthermore, because noise and vibration caused by pressure pulsation of the refrigerant are reduced, the fundamental frequency of the pressure pulsation of the refrigerant and the natural frequency of each member forming the injection passage 31 are kept from coinciding with each other, and noise and also vibration are reduced.

(8) Other (8-1)

The refrigerant pulsation attenuation effect can be further enhanced by setting the length of the injection passage 31 to a length that attenuates 70 Hz to 1400 Hz pulsation.

(8-2)

The refrigerant pulsation attenuation effect can be further enhanced by setting the expansion chamber 31*c* of the embodiment, the Helmholtz resonator 330 of the first example modification, and the side branch resonator 340 of the second example modification to attenuate 70 Hz to 1400 Hz pulsation.

(8-3)

Figure 7A:
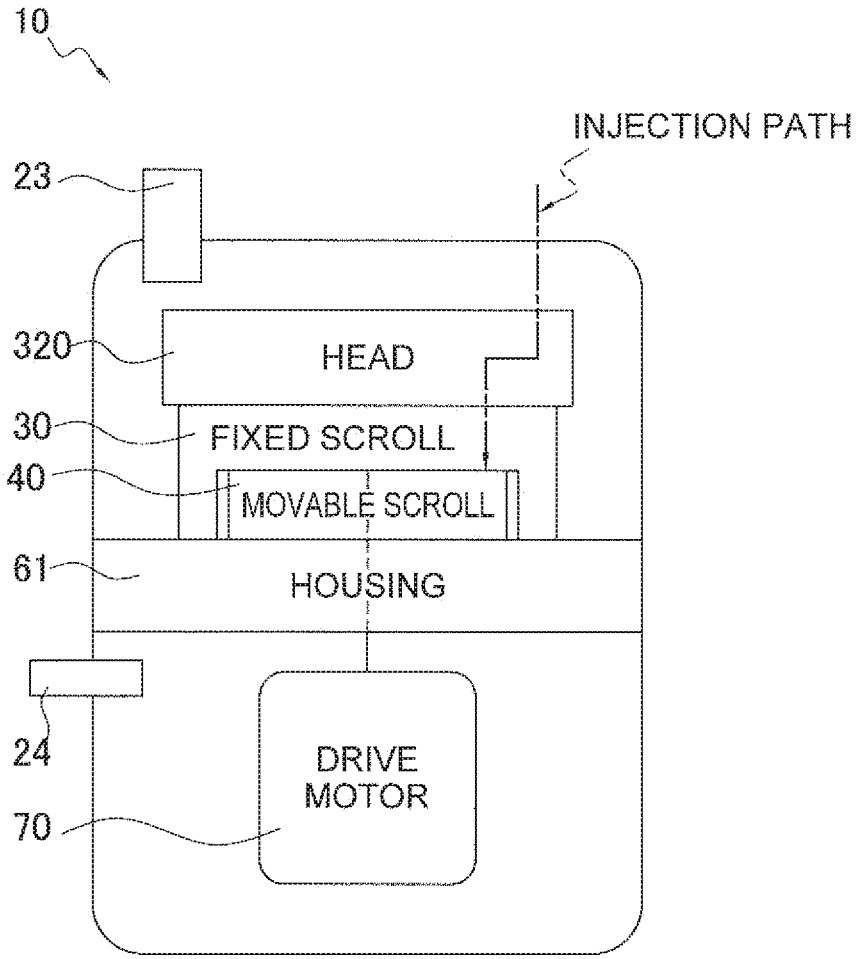
FIG. 7A is a general block diagram of the scroll compressor of FIG. 2.

FIG. 7A is a general block diagram of the scroll compressor 10 of FIG. 2. The path indicated by the long dashed double-short dashed line in FIG. 7A describes the injection pipe 25 and the injection passage 31 of FIG. 2 as a single injection path. As shown in FIG. 7A, in the above embodiment, the injection path employs a configuration that passes through the fixed scroll 30 from the head 320. However, the configuration of the injection path is not limited to the configuration shown in FIG. 7A.

Figure 7B:
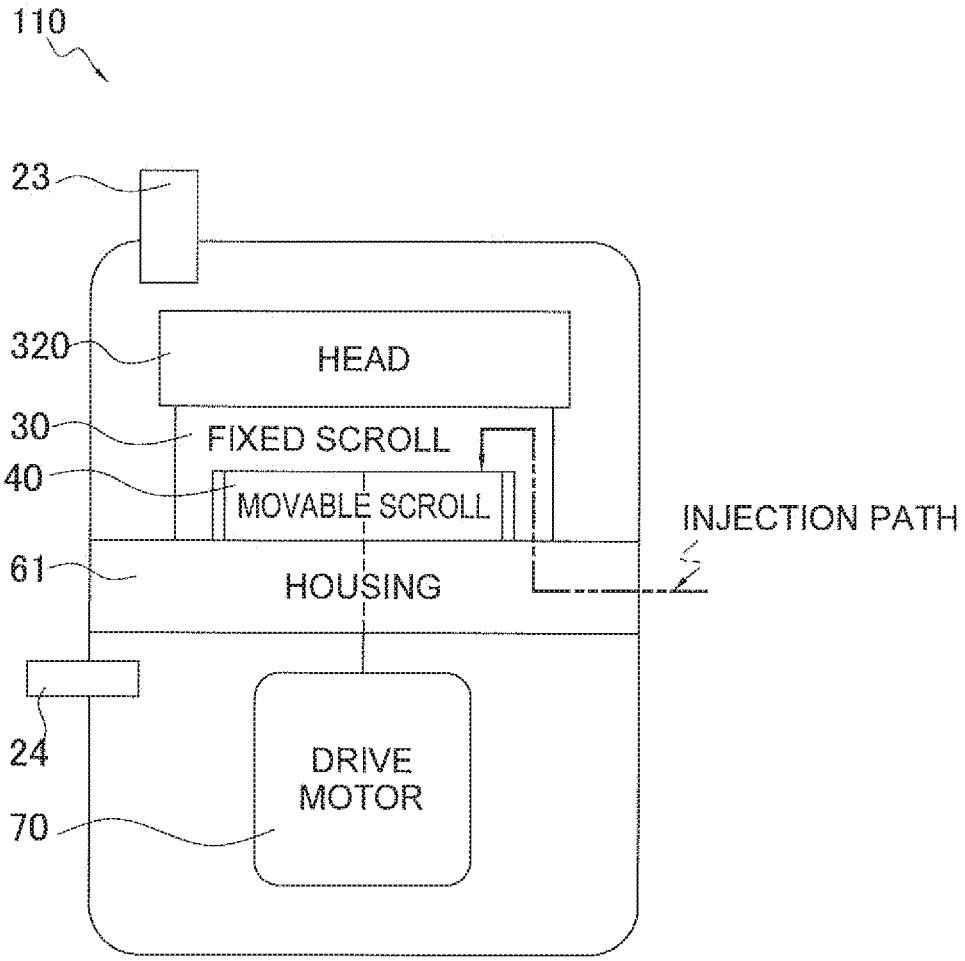
FIG. 7B is a general block diagram of a scroll compressor pertaining to another embodiment.

For example, FIG. 7B is a general block diagram of a scroll compressor 110 pertaining to another embodiment. The drive motor 70, the housing 61, the movable scroll 40, the fixed scroll 30, and the head 320 in FIG. 7B are the same as in FIG. 7A. What is different is the route taken by the injection path. In the scroll compressor 110, a configuration is employed where the injection path passes through the fixed scroll 30 from the housing 61.

In this way, variations in the configuration of the injection path are appropriately selected in accordance with use.

INDUSTRIAL APPLICABILITY

The present invention is useful not only in scroll compressors in which intermediate injection is performed but in all compressors requiring a reduction in pulsation during injection.

REFERENCE SIGNS LIST

10 Scroll Compressor (Compressor)
25 Injection Pipe
30 Fixed Scroll (Compression Chamber Forming Member)
31 Injection Passage
31*a* Injection Port
31*c* Expansion Chamber (Pulsation Attenuation Space)
320 Injection Pipe Connection Head (Separate Member)
330 Helmholtz Resonator (Pulsation Attenuation Space)
340 Sub Branch Resonator (Pulsation Attenuation Space)
40 Movable Scroll (Compression Chamber Forming Member)

CITATION LIST

Patent Literature

Patent Document 1: JP-A No. 2010-185406

What is claimed is:

1. A compressor comprising:

a compression chamber forming member, including a fixed scroll and a movable scroll, forming a compression chamber;

an injection passage formed in at least one of the compression chamber forming member and a separate member disposed in a surrounding area and connecting to the compression chamber;

an injection pipe supplying refrigerant to the injection passage; and an expansion chamber formed in one of the compression chamber forming member and the separate member disposed in the surrounding area so as to communicate with the injection passage, the expansion chamber attenuating pulsation of the refrigerant flowing from the injection pipe into the compression chamber, the expansion chamber being located in a flow path from the injection pipe to the compression chamber such that the refrigerant flows through the expansion chamber in order to reach the compression chamber, the compressor having a configuration such that a direction along which the refrigerant flows into the expansion chamber and a direction along which the refrigerant flows out of the expansion chamber intersect each other and an injection port lies on an extension line of the direction along which the refrigerant flows out of the expansion chamber, and the compression chamber and the injection passage communicating with each other by the injection port, and area centers of a flow path cross section on a refrigerant outflow side of the expansion chamber and a flow path cross section of the injection port lying on a common axis.

2. The compressor according to claim 1, wherein the expansion chamber has a larger flow path cross-sectional area than the flow path cross-sectional area of the injection port.

3. The compressor according to claim 2, wherein a ratio of the flow path cross-sectional area of the expansion chamber to the flow path cross-sectional area of the injection port is in a range of 2.0 to 50.

4. The compressor according to claim 3, wherein the expansion chamber is set to attenuate 70 Hz to 1400 Hz pulsation.

5. The compressor according to claim 2, wherein the expansion chamber is set to attenuate 70 Hz to 1400 Hz pulsation.

6. The compressor according to claim 1, wherein the expansion chamber is a Helmholtz space.

7. The compressor according to claim 6, wherein the expansion chamber is set to attenuate 70 Hz to 1400 Hz pulsation.

8. The compressor according to claim 1, wherein the expansion chamber is a side branch space.

9. The compressor according to claim 1, wherein a length of the injection passage is set to a length that attenuates 70 Hz to 1400 Hz pulsation.

10. The compressor according to claim 1, wherein the expansion chamber is set to attenuate 70 Hz to 1400 Hz pulsation.

11. A compressor comprising:

a compression chamber forming member, including a fixed scroll and a movable scroll, forming a compression chamber;

an injection passage formed in at least one of the compression chamber forming member and a separate member disposed in a surrounding area and connecting to the compression chamber;

an injection pipe supplying refrigerant to the injection passage; and an expansion chamber formed in one of the compression chamber forming member and the separate member disposed in the surrounding area so as to communicate with the injection passage, the expansion chamber attenuating pulsation of the refrigerant flowing from the injection pipe into the compression chamber, the expansion chamber being located in a flow path from the injection pipe to the compression chamber such that the refrigerant flows through the expansion chamber in order to reach the compression chamber, the compressor having a configuration such that a direction along which the refrigerant flows into the expansion chamber and a direction along which the refrigerant flows out of the expansion chamber intersect each other and an injection port lies on an extension line of the direction along which the refrigerant flows out of the expansion chamber, and a flow path cross section on a refrigerant outflow side of the expansion chamber and a flow path cross section of the injection port having a positional relationship such that the flow path cross section on the refrigerant outflow side of the expansion chamber and the flow path cross section of the injection port are parallel to each other and area centers of the flow path cross section on the refrigerant outflow side of the expansion chamber and the flow path cross section of the injection port do not lie on a common axis.

12. The compressor according to claim 11, wherein the expansion chamber is set to attenuate 70 Hz to 1400 Hz pulsation.

* * * * *